US009388484B2

(12) United States Patent
Takahashi

(10) Patent No.: US 9,388,484 B2
(45) Date of Patent: Jul. 12, 2016

(54) CONTINUOUS ANNEALING FURNACE FOR ANNEALING STEEL STRIP, METHOD FOR CONTINUOUSLY ANNEALING STEEL STRIP, CONTINUOUS HOT-DIP GALVANIZING FACILITY, AND METHOD FOR MANUFACTURING HOT-DIP GALVANIZED STEEL STRIP

(71) Applicant: JFE STEEL CORPORATION, Chiyoda-ku, Tokyo (JP)

(72) Inventor: Hideyuki Takahashi, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 14/402,979

(22) PCT Filed: May 20, 2013

(86) PCT No.: PCT/JP2013/003190
§ 371 (c)(1),
(2) Date: Nov. 21, 2014

(87) PCT Pub. No.: WO2013/175757
PCT Pub. Date: Nov. 28, 2013

(65) Prior Publication Data

US 2015/0140218 A1 May 21, 2015

(30) Foreign Application Priority Data

May 24, 2012 (JP) ..... 2012-118117

(51) Int. Cl.
*C23C 2/40* (2006.01)
*C23C 2/02* (2006.01)
(Continued)

(52) U.S. Cl.
CPC ... *C23C 2/40* (2013.01); *C21D 1/26* (2013.01); *C21D 1/74* (2013.01); *C21D 1/76* (2013.01); *C21D 8/0205* (2013.01); *C21D 9/005* (2013.01); *C21D 9/56* (2013.01); *C21D 9/561* (2013.01);
(Continued)

(58) Field of Classification Search
None
See application file for complete search history.

(56) References Cited

U.S. PATENT DOCUMENTS

2009/0123651 A1 5/2009 Okada
2010/0044932 A1 2/2010 Sugano

FOREIGN PATENT DOCUMENTS

JP 2567130 12/1996
JP 2567140 12/1996
(Continued)

OTHER PUBLICATIONS

European Search Report mailed May 4, 2015 for European Application No. 13794610.9.
(Continued)

*Primary Examiner* — Nathan T Leong
(74) *Attorney, Agent, or Firm* — RatnerPrestia

(57) ABSTRACT

A continuous annealing furnace for annealing steel strips that is a vertical-type annealing furnace is configured so that part of gas inside the furnace is drawn and introduced to a refiner disposed outside the furnace including an oxygen removing apparatus and a dehumidifying apparatus, oxygen and moisture contained in the gas are removed to lower the dew point of the gas, and the gas having a lowered dew point is put back into the furnace. At least one gas inlet through which gas is drawn from the furnace into the refiner is disposed in the vicinity of the entry side of the furnace at a distance of 6 m or less in the vertical direction and 3 m or less in the furnace-length direction from the steel-strip-introduction section located at the lower part of the heating zone.

2 Claims, 5 Drawing Sheets

(51) Int. Cl.

| | |
|---|---|
| ***C23C 2/06*** | (2006.01) |
| ***C23C 2/26*** | (2006.01) |
| ***C23C 2/28*** | (2006.01) |
| ***C21D 9/56*** | (2006.01) |
| ***F27D 7/06*** | (2006.01) |
| ***C21D 1/74*** | (2006.01) |
| ***C21D 1/76*** | (2006.01) |
| ***C21D 1/26*** | (2006.01) |
| ***F27D 7/04*** | (2006.01) |
| ***C21D 8/02*** | (2006.01) |
| ***C21D 9/00*** | (2006.01) |
| ***C23C 2/00*** | (2006.01) |
| ***F27B 9/04*** | (2006.01) |
| ***F27B 9/14*** | (2006.01) |
| ***F27D 99/00*** | (2010.01) |

(52) U.S. Cl.

CPC . *C23C 2/003* (2013.01); *C23C 2/02* (2013.01); *C23C 2/06* (2013.01); *C23C 2/26* (2013.01); *C23C 2/28* (2013.01); *F27B 9/045* (2013.01); *F27B 9/145* (2013.01); *F27D 7/04* (2013.01); *F27D 7/06* (2013.01); *F27D 99/0073* (2013.01)

(56) References Cited

FOREIGN PATENT DOCUMENTS

| | | |
|---|---|---|
| JP | 09324210 | 12/1997 |
| JP | 2003129125 | 5/2003 |
| JP | 2011046988 | 3/2011 |
| WO | 2007043273 | 4/2007 |
| WO | 2008099970 | 8/2008 |

OTHER PUBLICATIONS

International Search Report for International Application No. PCT/JP2013/003190 mailed Aug. 6, 2013.

CONTINUOUS ANNEALING FURNACE FOR ANNEALING STEEL STRIP, METHOD FOR CONTINUOUSLY ANNEALING STEEL STRIP, CONTINUOUS HOT-DIP GALVANIZING FACILITY, AND METHOD FOR MANUFACTURING HOT-DIP GALVANIZED STEEL STRIP

CROSS REFERENCE TO RELATED APPLICATIONS

This is the U.S. National Phase application of PCT/JP2013/003190, filed May 20, 2013, which claims priority to Japanese Patent Application No. 2012-118117, filed May 24, 2012, the disclosures of each of these applications being incorporated herein by reference in their entireties for all purposes.

FIELD OF THE INVENTION

The present invention relates to a continuous annealing furnace for annealing steel strips, a method for continuously annealing steel strips, a continuous hot-dip galvanizing facility, and a method for manufacturing hot-dip galvanized steel strips.

BACKGROUND OF THE INVENTION

Hitherto, in a continuous annealing furnace used for annealing steel strips, for example, when the furnace is started after being opened to air or when air enters the furnace atmosphere, in order to reduce the moisture and oxygen concentration in the furnace, a method in which non-oxidizing gas such as inert gas, which serves as gas replacing the furnace atmosphere, is supplied into the furnace and simultaneously the gas in the furnace is exhausted in order to replace the furnace atmosphere by the non-oxidizing gas while the furnace temperature is increased in order to vaporize the moisture in the furnace has been widely employed.

However, in the case where the existing method described above is employed, there is a problem in that productivity may be reduced considerably because a long period of time is required to reduce the moisture and oxygen concentration in the furnace atmosphere to a certain level that is suitable for the normal operation of the furnace and it is impossible to operate the furnace during that period of time.

On the other hand, recently, there has been an increase in demands for high-tensile steel (high-tensile material) that contributes to the fields of automobiles, home appliances, building materials, and the like by, for example, reducing the weight of a structure. In the technique for manufacturing high-tensile materials, it is indicated that there is a possibility that high-tensile steel strips having good hole expandability can be manufactured by adding Si to steel. In the technique for manufacturing high-tensile materials, it is also indicated that there is a possibility that steel strips in which retained $\gamma$ is likely to be formed and which has high ductility can be provided by adding Si or Al to steel.

However, in the case where a high-strength cold-rolled steel strip contains an oxidizable element such as Si or Mn, there is a problem in that the oxidizable element concentrates at the surface of the steel strip during annealing and thereby forms an oxide of Si, Mn, or the like, which may disadvantageously result in poor appearance and deteriorate ease of a chemical conversion treatment such as a phosphate treatment.

In manufacture of hot-dip galvanizing steel strips, in the case where the steel strip contains an oxidizable element such as Si, Mn, or the like, there is a problem in that the oxidizable element concentrates at the surface of the steel strip during annealing and thereby forms an oxide of Si, Mn, or the like. This may deteriorate ease of plating, which causes plating defects. In addition, when an alloying treatment is performed after plating, the alloying rate may be reduced. In particular, Si considerably reduces the wettability of the steel strip with a molten plating metal when Si forms an oxide film of $SiO_2$ on the surface of the steel strip. Furthermore, the oxide film of $SiO_2$ acts as a barrier to diffusion of the plated metal and the base steel during the alloying treatment. Thus, Si is especially likely to deteriorate ease of plating and degrade ease of an alloying treatment.

As a method for avoiding the above-described problems, a method in which the oxygen potential in the annealing atmosphere is controlled is considered.

As a method in which the oxygen potential is increased, for example, Patent Literature 1 discloses a method in which the dew point in a region from the latter part of a heating zone to a soaking zone is controlled to a high dew point of −30° C. or more. This method works to some extent and is advantageous in that controlling the dew point to be high can be achieved industrially easily. However, this method is disadvantageous in that a certain type of steel (e.g., Ti-IF steel) that is undesirably subjected to an operation under a high dew point is not able to be manufactured easily by this method. This is because lowering the dew point of an annealing atmosphere which has been increased to a high dew point once to a low dew point requires a quite long period of time. Moreover, since the furnace atmosphere is set oxidative in this method, there is a problem in that a mistake in controlling the dew point may cause an oxide to adhere to the rolls disposed in the furnace, which causes pick-up defects, and there is also a problem of damages to the furnace wall.

As another method, a method in which the oxygen potential is reduced may be proposed. However, since Si, Mn, and the like are quite oxidative, it has been considered that it is very difficult to consistently achieve atmosphere having a low dew point of −40° C. or less which markedly suppresses oxidation of Si, Mn, or the like in a large continuous-annealing furnace installed in a CGL (continuous hot-dip galvanizing line) or a CAL (continuous annealing line).

Techniques for preparing annealing atmosphere having a low dew point with efficiency are disclosed in, for example, Patent Literatures 2 and 3. These techniques are directed to one-pass vertical-type furnaces, that is, relatively small furnaces but are not supposed to be applied to multipass vertical-type furnaces such as a CGL and a CAL. Therefore, there is a high risk that the dew point fails to be efficiently lowered by the technique.

PATENT LITERATURE

[PTL 1] WO2007/043273
[PTL 2] Japanese Patent No. 2567140
[PTL 3] Japanese Patent No. 2567130

SUMMARY OF THE INVENTION

An object of the present invention is to provide a continuous annealing furnace for annealing steel strips in which, prior to starting normal operation in which steel strips are continuously subjected to a heat treatment or when the moisture concentration and/or the oxygen concentration in the furnace atmosphere is increased during the normal operation, the dew point of the furnace atmosphere can be rapidly lowered to a level suitable for the normal operation. Another object of the present invention is to provide a continuous annealing furnace for annealing steel strips in which atmosphere having a low dew point, which is less likely to cause pick-up defects and damages to furnace walls, is consistently achieved, in which formation of an oxide of an oxidizable element such as Si, Mn, or the like contained in steel which is concentrated at the surface of a steel strip during annealing, can be suppressed, and which is suitably used for annealing steel strips containing oxidizable elements such as Si. Still another object of the present invention is to provide a method for continuously annealing steel strips using the above-described continuous annealing furnace.

Yet another object of the present invention is to provide a continuous hot-dip galvanizing facility including the above-described annealing furnace. Another object of the present invention is to provide a method for manufacturing a hot-dip galvanizing steel strip in which a steel strip is continuously annealed by the above-described annealing method and subsequently subjected to hot-dip galvanizing.

Note that the technique according to the present invention is applicable regardless of the presence or absence of a partition that physically separates a heating zone and a soaking zone of an annealing furnace.

The inventors of the present invention have measured the distribution of dew points in a large multipass vertical-type furnace and conducted a flow analysis and the like based on the dew-point distribution. As a result, the inventors have obtained the following findings:

1) In a multipass vertical-type annealing furnace, the dew point at the upper part of the furnace tends to be high because water vapor ($H_2O$) has a lower specific gravity than $N_2$ gas that constitutes a large part of the atmosphere;

2) The dew point at the upper part of the furnace can be prevented from becoming high by drawing gas inside the furnace from the upper part of the furnace, introducing the gas into a refiner including an oxygen remover and a dehumidifier, removing oxygen and moisture in order to lower the dew point, and putting back the resulting gas having a lowered dew point to a specific part of the furnace, and the dew point of the furnace atmosphere can be lowered to a certain level suitable for the normal operation in a short time. Further, it is possible to consistently prepare an atmosphere having a low dew point which is less likely to cause pick-up defects and damages to furnace walls and in which formation of an oxide of an oxidizable element such as Si, Mn, or the like contained in steel, which concentrates at the surface of a steel strip during annealing, can be suppressed.

In order to address the above-described problems, the present invention includes the following:

(1) A continuous annealing furnace for annealing steel strips that is a vertical-type annealing furnace including a heating zone, a soaking zone, and a cooling zone which are disposed in this order and in which the steel strips are transported vertically, the vertical-type annealing furnace being configured so that, while atmosphere gas is supplied from the outside of the furnace into the furnace and gas inside the furnace is exhausted through a steel-strip-introduction section located at the lower part of the heating zone, part of the gas inside the furnace is drawn and introduced to a refiner disposed outside the furnace, the refiner including an oxygen removing apparatus and a dehumidifying apparatus, oxygen and moisture contained in the gas are removed to lower the dew point of the gas, and gas having a lowered dew point is put back into the furnace. At least one gas inlet through which gas is drawn from the furnace into the refiner is disposed in the vicinity of the entry side of the furnace at a distance of 6 m or less in the vertical direction and 3 m or less in the furnace-length direction from the steel-strip-introduction section located at the lower part of the heating zone;

(2) A method for continuously annealing a steel strip, the method including, when a steel strip is continuously annealed using the continuous annealing furnace for annealing steel strips described in (1), controlling the upper limit of the amount of gas drawn through the inlet disposed in the vicinity of the entry side of the furnace so that an increase in the dew point of gas inside the furnace in the vicinity of the inlet compared with a condition where gas is not drawn through the inlet is less than 3° C., where the expression "a condition where gas is not drawn through the inlet" refers to a condition where gas is not drawn through the inlet while the refiner is operated at the same flow rate;

(3) A continuous hot-dip galvanizing facility including a hot-dip galvanizing facility downstream of the continuous annealing furnace described in (1); and (4) A method for manufacturing a hot-dip galvanizing steel strip, the method including continuously annealing a steel strip by the method described in (2) and subsequently performing hot-dip galvanizing.

According to embodiments of the present invention, prior to starting a normal operation in which steel strips are continuously subjected to a heating treatment or when the moisture concentration and/or the oxygen concentration in the furnace atmosphere is increased during the normal operation, a time required for reducing the moisture concentration and/or the oxygen concentration in the furnace atmosphere and thereby lowering the dew point of the furnace atmosphere to −30° C. or less, at which consistent manufacture of steel strips is realized, can be shortened, which suppresses a reduction in productivity.

According to the present invention, occurrence of pick-up defects and damages to furnace walls can be suppressed. In addition, furnace atmosphere having a low dew point of −40° C. or less, which suppresses formation of an oxide of an oxidizable element such as Si, Mn, or the like contained in steel which concentrates at the surface of the steel strip during annealing, can be consistently prepared. According to the present invention, a certain type of steel, for which an operation under a high dew point is undesirable, such as Ti-IF steel, can be easily manufactured.

According to embodiments of the present invention, a gas inlet through which gas is drawn into the refiner is provided in the vicinity of the entry side of the furnace at a distance of 6 m or less in the vertical direction and 3 m or less in the furnace-length direction from the steel-strip-introduction section located at the lower part of the heating zone on the furnace-entry side, and thereby an increase in the dew point caused due to the gas drawn through the inlet is controlled. This maximizes the effect of the refiner ejection gas and further enhances the dehumidification efficiency of the refiner.

DETAILED DESCRIPTION OF EMBODIMENTS OF THE INVENTION

Figure 1:
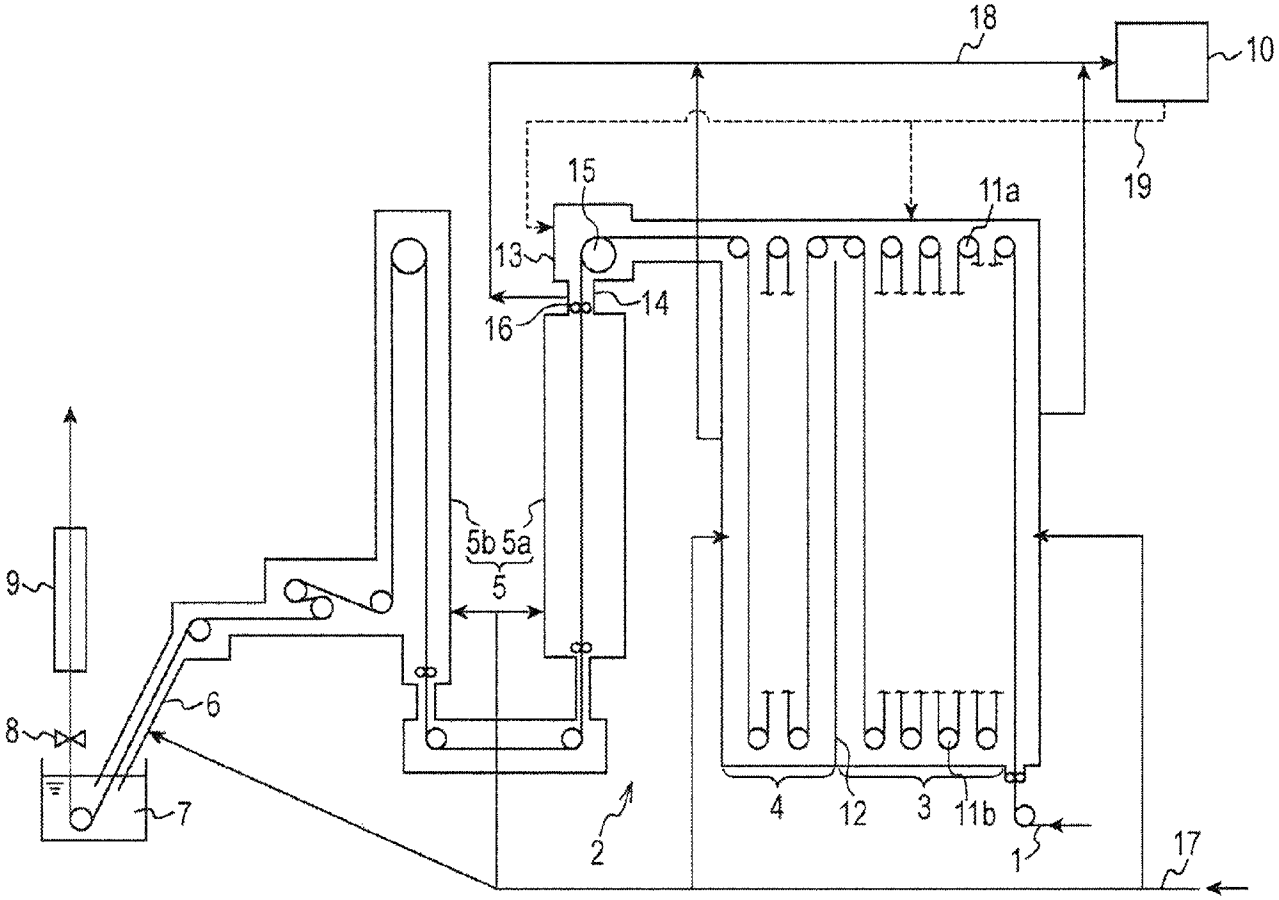
FIG. 1 is a diagram illustrating an example of the structure of a continuous hot-dip galvanizing line including a continuous annealing furnace for annealing steel strips according to an embodiment of the present invention.

A continuous hot-dip galvanizing line for galvanizing steel strips includes an annealing furnace located upstream of a plating bath. Commonly, in an annealing furnace, a heating zone, a soaking zone, and a cooling zone are arranged in this order in the direction from the upstream to the downstream of the furnace. A preheating zone may be optionally provided upstream of the heating zone. The annealing furnace and the plating bath are joined to each other through a snout. The inside of the furnace that extends from the heating zone to the snout is maintained in reducing atmosphere gas or in a non-oxidizing atmosphere. In the heating zone and the soaking zone, a radiant tube (RT) is used as heating means, with which steel strips are indirectly heated. Commonly, $H_2$—$N_2$ gas is used as reducing atmosphere gas, which is introduced to the inside of the furnace that extends from the heating zone to the snout as needed. In the above-described line, a steel strip is heated and annealed at a predetermined temperature in the heating zone and the soaking zone. The annealed steel strip is cooled in the cooling zone, and then, through the snout, dipped in the plating bath to perform hot-dip galvanizing. Subsequently, an alloying treatment of the galvanizing metal may optionally be performed.

In the continuous hot-dip galvanizing line, the furnace is joined to the plating bath through the snout. Therefore, gas introduced inside the furnace is exhausted through the entry side of the furnace except for inevitable gas such as gas leaking out through the furnace body. Thus, the gas inside the furnace flows in the direction from the downstream to the upstream of the furnace, which is opposite to the direction in which steel strips are transported. Since water vapor ($H_2O$) has a low specific gravity than $N_2$ gas, which constitutes a large part of the atmosphere, the dew point in the upper part of the furnace tends to be high in a multipass vertical-type annealing furnace.

In order to efficiently lower the dew point, it is important to suppress an increase in the dew point at the upper part of the furnace without causing retention of the atmosphere gas in the furnace (retention of the atmosphere gas in the upper, middle, and lower parts of the furnace). In order to efficiently lower the dew point, it is also important to detect the origin of water that increases the dew point. Examples of the origin of water include furnace walls, steel strips, the outside air entered through the entrance of the furnace, and inflows from the cooling zone, the snout, and the like. A leakage point formed in the RT or furnace walls may also act as the origin of water.

The higher the temperature of steel strips, the greater the impact of dew point on degradation of ease of plating. The impact particularly becomes great at a steel-strip temperature of 700° C. or more, at which reactivity with oxygen is high. Thus, the dew point in the latter part of the heating zone and the soaking zone, in which the temperature is high, greatly affects ease of plating. It is necessary to efficiently lower the dew point over the entirety of the heating zone and the soaking zone regardless of the presence or absence of a partition or the like that physically separates the heating zone and the soaking zone from each other.

Specifically, it is necessary to be able to shorten the time required for, prior to starting a normal operation in which steel strips are continuously subjected to a heat treatment or when the moisture concentration and/or the oxygen concentration in the atmosphere of the furnace is increased during the normal operation, reducing the moisture concentration and/or the oxygen concentration in the atmosphere of the furnace and thereby lowering the dew point of the atmosphere in the entire furnace to −30° C. or less, at which a consistent manufacture of steel strips is realized.

In the latter part of the heating zone and in the soaking zone, it is necessary to lower the dew point to −40° C. or less, at which oxidation of Si, Mn, or the like can be suppressed with effect. From the viewpoint of ease of plating, the lower the dew point is, the greater the advantage is. The dew point is preferably lowered to −45° C. or less and more preferably lowered to −50° C. or less.

In embodiments of the present invention, in order to lower the dew point of atmosphere gas, part of the atmosphere gas in the furnace is introduced to a refiner disposed outside the furnace, which includes an oxygen removing apparatus and a dehumidifying apparatus, then oxygen and moisture contained in the gas are removed to lower the dew point of the gas, and the resultant gas having a lowered dew point is put back into the furnace. In the present invention, at this time, in order to effectively use gas inside the furnace which is to be introduced into the refiner, gas inlets through which gas is drawn into the refiner are preferably disposed and managed under the following conditions:

1) At least one gas inlet through which gas is drawn into the refiner is disposed in the vicinity of the entry side of the furnace (a region at a distance of 6 m or less in the vertical direction and 3 m or less in the furnace-length direction from the steel-strip-introduction section located at the lower part of the heating zone). The upper limit of the flow rate at which gas is drawn through the inlet is managed so that the dew point measured at the inlet does not increase by 3° C. or more compared with the case where gas is not drawn through the inlet;

2) Although the positions of gas outlets through which gas is ejected from the refiner are not particularly limited, in order to efficiently lower the dew point, the gas outlets are desirably disposed at the positions as far from the entry side of the furnace as possible. This is because, in the case where the outlets are disposed at positions close to the entry side of the furnace, gas having a low dew point is disadvantageously exhausted outside in a short time and, as a result, the gas having a low dew point cannot work effectively.

It is considered that the origin of water in the furnace is mainly, as long as any special event such as trouble does not occur, a) inflow from the entry side of the furnace, b) reduction of a naturally-oxidized film, and c) bleeding of water from a furnace wall. Disposing inlets on the furnace-entry side is advantageous in the following points:

(i) Efficient dehumidification is realized because the dew point tends to be the highest on the furnace-entry side;

(ii) Disposing inlets on the furnace-entry side results in formation of a large stream of gas flowing from the soaking zone toward the heating zone, which prevents the atmosphere on the furnace-entry side, which has a high dew point, from entering a region subsequent to the latter part of the heating zone, at which the temperature of the steel strips is high; and (iii) Since the entrance of the furnace serves also as an exit of gas, the most of the effect of the refiner gas is made inside the furnace.

The present invention has been made on the basis of the above-described viewpoints.

An embodiment of the present invention is described below with reference to FIGS. 1 to 3.

FIG. 1 shows an example of a structure of a continuous hot-dip galvanizing line for galvanizing steel strips including a vertical-type annealing furnace according to an embodiment of the present invention. In FIG. 1, reference numeral 1 denotes a steel strip, and reference numeral 2 denotes an annealing furnace, which includes a heating zone 3, a soaking zone 4, and a cooling zone 5 in this order in the direction in which the steel strip is transported. In the heating zone 3 and the soaking zone 4, a plurality of upper hearth rolls 11*a* and a plurality of lower hearth rolls 11*b* are disposed, which define a plurality of passes over which the steel strip 1 is vertically transported a plurality of times. In the heating zone 3 and the soaking zone 4, the steel strip 1 is heated indirectly using a RT that serves as heating means. Reference numeral 6 denotes a snout, reference numeral 7 denotes a plating bath, reference numeral 8 denotes a gas-wiping nozzle, reference numeral 9 denotes a heating apparatus used for an alloying treatment of a plated metal, and reference numeral 10 denotes a refiner used for removing oxygen from and performing dehumidification of atmosphere gas drawn from the inside of the furnace.

The heating zone 3 and the soaking zone 4 are communicated through the upper part of the furnace. The steel strip is passed through the communicating section and subsequently introduced into the soaking zone. A partition 12 is disposed in the furnace except for the communicating section located at the upper part of the furnace. The partition 12 blocks atmosphere gases in the heating zone 3 and the soaking zone 4 from each other. The partition 12 is located at a position intermediate between the upper hearth roll disposed at the exit of the heating zone 3 and the upper hearth roll disposed at the entrance of the soaking zone 4 in the furnace-length direction. The partition 12 is arranged vertically so that the upper edge thereof is adjacent to the steel strip 1 and so that the lower edge thereof and other edges thereof in the steel-strip-width direction are brought into contact with the furnace walls.

A joining section 13, through which the soaking zone 4 and the cooling zone 5 are joined, is disposed at the upper part of the furnace above the cooling zone 5. In the joining section 13, a roll 15 is disposed, which is used for changing the direction in which the steel strip 1 drawn from the soaking zone 4 is transported to a downward direction. In order to prevent the atmosphere in the soaking zone 4 from entering the cooling zone 5 and to prevent radiant heat generated from the furnace walls of the joining section from entering the cooling zone 5, the cooling-zone-5-side exit located at the lower part of the joining section is designed in the form of a throat (a structure in which the area of a cross section taken at the steel-strip-passing section is reduced, i.e., a throat section). In the throat section 14, seal rolls 16 are disposed.

The cooling zone 5 is constituted by a first cooling zone 5*a* and a second cooling zone 5*b*. In the first cooling zone 5*a*, the number of steel-strip passes is one.

In FIG. 1, reference numeral 17 denotes atmosphere gas supply lines through which atmosphere gas is supplied from the outside of the furnace into the furnace; reference numeral 18 denotes gas-introduction tubes through which gas is supplied to the refiner 10; and reference numeral 19 denotes gas-delivery tubes through which gas is supplied from the refiner 10.

Using valves (not shown) and flowmeters (not shown) disposed at the midpoint of each of the atmosphere gas supply lines 17 connected to the respective zones, the amount of atmosphere gas supplied to each of the heating zone 3, the soaking zone 4, the cooling zone 5, and the subsequent zones in the furnace can be independently controlled. Supply of the atmosphere gas into these zones can also be independently stopped. Generally, in order to cause an oxide that is present on the surface of the steel strip to be reduced and to prevent the cost of atmosphere gas from being excessively high, gas having a composition including $H_2$: 1 vol % to 10 vol % and the balance being $N_2$ and inevitable impurities is used as atmosphere gas supplied into the furnace. The dew point of the atmosphere gas supplied into the furnace is about −60° C.

Figure 2:
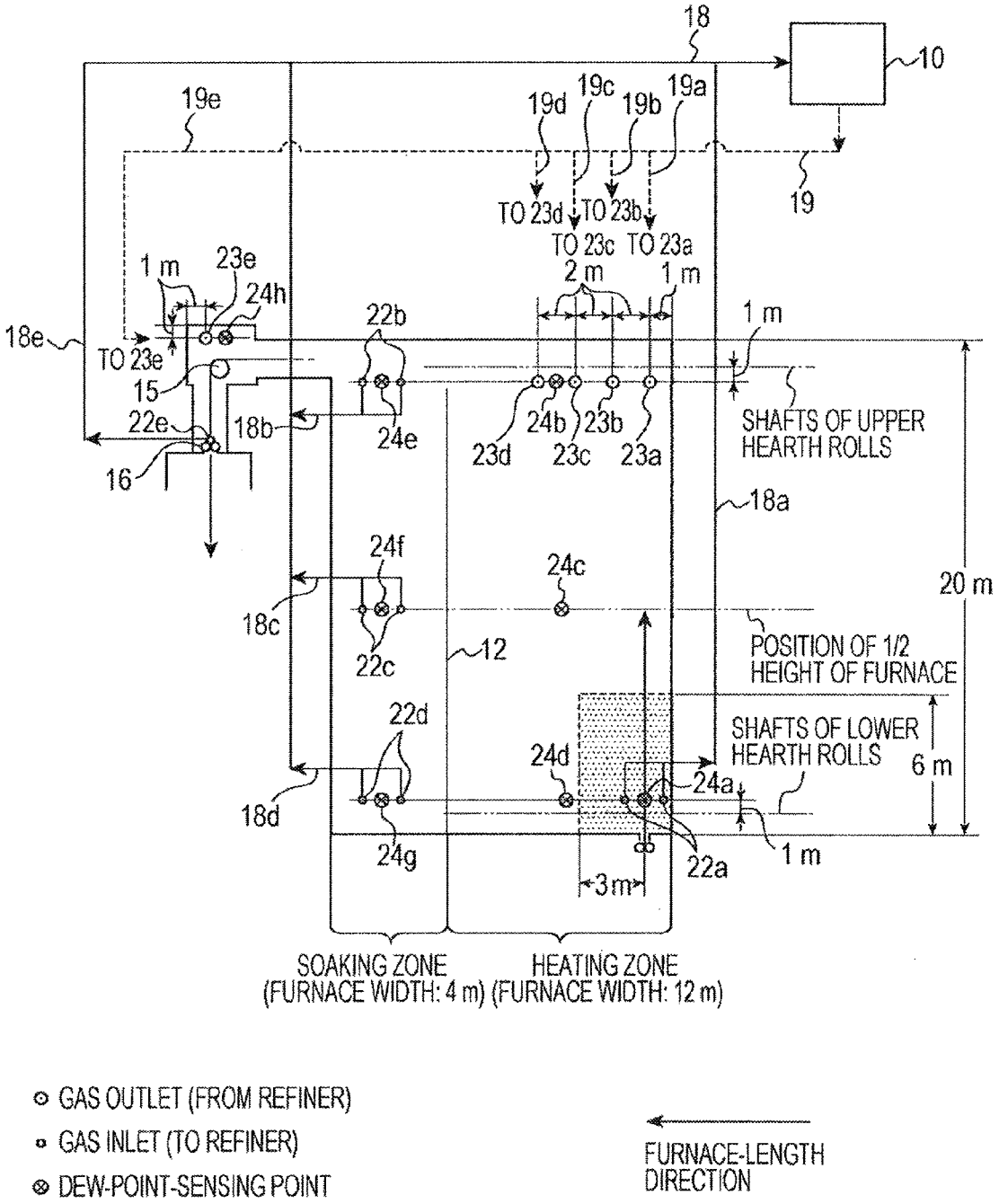
FIG. 2 is a diagram illustrating an example of an arrangement of gas inlets through which gas is drawn into the refiner, gas outlets through which gas is ejected from the refiner, and dew-point-sensing points.

FIG. 2 shows an example of an arrangement of gas inlets through which gas is drawn into the refiner 10, gas outlets through which gas is ejected from the refiner 10, and dew-point-sensing points. Reference numerals 22*a* to 22*e* denote the gas inlets. Reference numerals 23*a* to 23*e* denote the gas outlets. Reference numerals 24*a* to 24*h* denote the dew-point-sensing points. The furnace width of the heating zone is 12 m. The furnace width of the soaking zone is 4 m. The total furnace width of the heating zone and the soaking zone is 16 m.

The gas inlets through which gas is drawn from the furnace into the refiner are disposed at the following positions: the throat section located at the lower part of the joining section through which the soaking zone and the cooling zone are joined (22*e*); 1 m below the shafts of the upper hearth rolls disposed in the soaking zone (22*b*); the center of the soaking zone (the center both in the height direction and in the furnace-length direction: 22*c*); 1 m above the shafts of the lower hearth rolls disposed in the soaking zone (22*d*); and the vicinity of the entry side of the furnace (on both sides of the pass line of the steel-strip-introduction section, at a position 0.5 m from the pass line and 1 m above the shafts of the lower hearth rolls: 22*a*).

Gas is drawn at all times through the inlet disposed at the lower part of the joining section through which the soaking zone and the cooling zone are joined and through the inlets disposed in the vicinity of the entry side of the furnace.

The gas outlets through which gas is ejected from the refiner into the furnace are disposed at the following positions: a position above the pass line in the joining section through which the soaking zone and the cooling zone are joined and 1 m from both the exit-side furnace wall and the ceiling wall (23*e*); and four positions 1 m below the shafts of the upper hearth rolls disposed in the heating zone, at intervals of 2 m with the starting point located at a position 1 m from the furnace wall on the furnace-entry side (23*a* to 23*d*)). The inlets have a diameter of ϕ200 mm and, except in the joining section, are disposed in pairs at intervals of 1 m; in the joining section, a single inlet is disposed. The outlets have a diameter of ϕ50 mm, and a single outlet is disposed in the joining section; at the upper part of the heating zone, four outlets are disposed as described above.

The dew-point-sensing points for detecting the dew point of gas inside the furnace are disposed at the following positions: the vicinity of the entry side of the furnace (24*a*); the joining section through which the soaking zone and the cooling zone are joined (24*h*); points intermediate between two inlets of each pair disposed in the soaking zone (24*e* to 24*g*); a point intermediate between the third and fourth outlets from the furnace wall on the heating-zone-entry side (point intermediate between the outlets 23*c* and 23*d*: 24*b*); the center of the heating zone (center both in the height direction and in the furnace-length direction: 24*c*); and a position 1 m above the shafts of the lower hearth rolls disposed in the heating zone and 6 m from the furnace wall on the furnace-entry side (24*d*). The dew-point-sensing point disposed in the vicinity of the entry side of the furnace is disposed at a point intermediate between the two gas outlets disposed on the furnace-entry side.

The dew-point-sensing points 24*e* to 24*g* disposed in the soaking zone are arranged at the center of the soaking zone in the furnace-length direction. The dew-point-sensing points 24*b* to 24*d* are arranged at the center of the heating zone in the furnace-length direction. The dew-point-sensing points disposed at positions at which a gas inlet or a gas outlet is disposed are arranged at the same heights (positions in the vertical direction) as the gas inlet or the gas outlet.

In embodiments of the present invention, the dew point of gas inside the furnace which is measured at the dew-point-sensing point 24*a* disposed in the vicinity of the entry side of the furnace as described above, is controlled so that an increase in the dew point of gas inside the furnace in the vicinity of the inlet 22*a* is less than 3° C. compared with a condition where gas is not drawn through the inlet 22*a* disposed on the vicinity of the furnace-entry side. The expression "condition where gas is not drawn through the inlet 22*a*" herein refers to a condition where gas is not drawn through the inlet 22*a* while the refiner is operated at the same flow rate. The reason for managing an increase in the dew point measured on the furnace-entry side by controlling the amount of gas drawn is described below.

Since the region including the entry side of the furnace is the nearest to the outside air, the dew point in this region is quite likely to be high. In this regard, drawing gas to be supplied to the refiner from the region including the entry side of the furnace is efficient. However, if the seal at the furnace-entry side is unsatisfactorily weak or the flow rate of the gas drawn is excessively high, the outside gas having a high dew point may be drawn, which increases the dew point. This may adversely affect the reduction in the dew point in the entire furnace. That is, this may negatively work toward lowering the dew point in the entire furnace. Thus, in embodiments of the present invention, the dew point measured at the above-described position is managed and an increase in the dew point at the position is controlled to less than 3° C. If the increase in dew point is 3° C. or more, the effect of the dew point in the entire furnace being lowered is not produced.

In order to control an increase in dew point to be less than 3° C., the amount of gas drawn through the inlets disposed in the vicinity of the entry side of the furnace may be controlled so that the increase in dew point is less than 3° C. Alternatively, the degree to which the furnace-entry side is sealed may be enhanced in order to control the increase in dew point to be less than 3° C. In another case, both of these methods may be employed in a combined manner. In order to control the amount of gas drawn, the amount of gas drawn: Q ($Nm^3$/hr) and the total furnace volume of the heating zone and the soaking zone: V ($m^3$) preferably satisfy $Q>V/20$. The degree to which the furnace-entry side is sealed may be enhanced by, for example, disposing double pairs of seal rolls at the furnace entrance, physically surrounding the seal rolls, or performing an optional atmosphere gas sealing.

The atmosphere gas drawn through the gas inlets can be introduced into the refiner through the gas-introduction tubes 18*a* to 18*e* and 18. Using the valves (not shown) and the flowmeters (no shown), which are respectively disposed midway along each of the gas-introduction tubes 18*a* to 18*e*, the amount of atmosphere gas in the furnace which is drawn through the respective inlets can be individually controlled. Supply of the atmosphere gas through these inlets can also be independently stopped.

Figure 3:
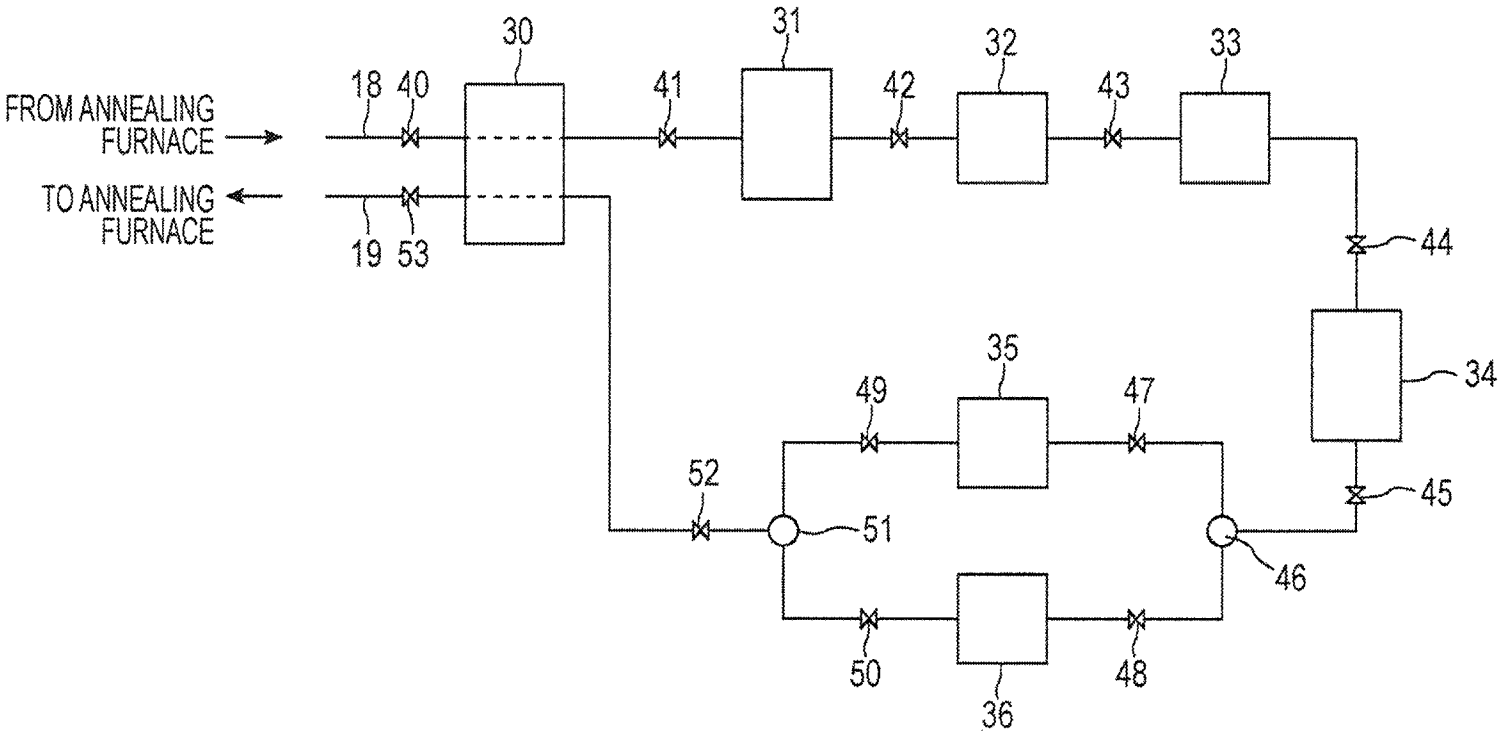
FIG. 3 is a diagram illustrating an example of the structure of a refiner.
Figure 4:
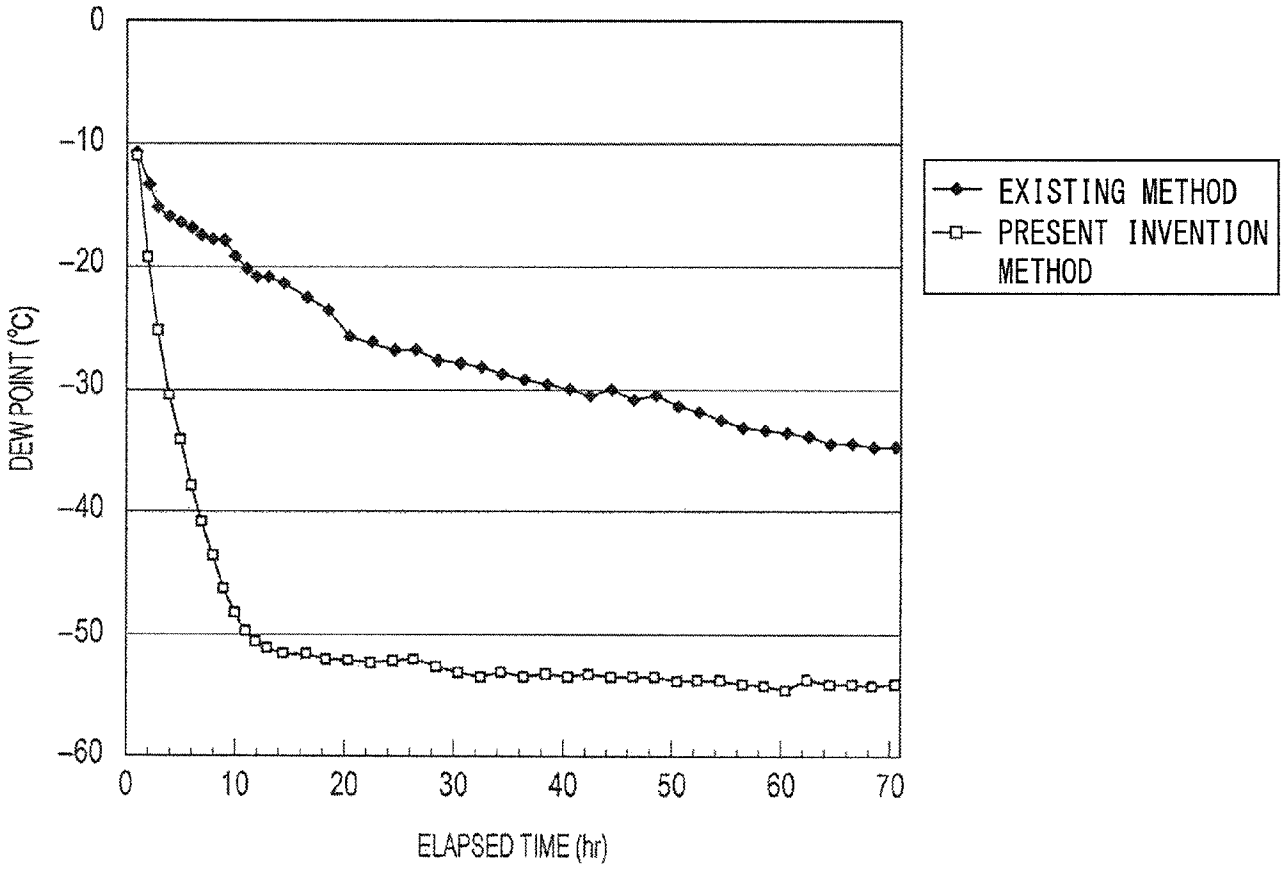
FIG. 4 is a graph showing a tendency in which the dew point in an annealing furnace is lowered.

FIG. 3 shows an example of the structure of the refiner 10. In FIG. 3, reference numeral 30 denotes a heat exchanger; reference numeral 31 denotes a cooler; reference numeral 32 denotes a filter; reference numeral 33 denotes a blower; reference numeral 34 denotes an oxygen removing apparatus; reference numerals 35 and 36 denote dehumidifying apparatuses; reference numerals 46 and 51 denote switching valves; and reference numerals 40 to 45, 47 to 50, 52, and 53 denote valves. The oxygen removing apparatus 34 is an oxygen removing apparatus using a palladium catalyst. The dehumidifying apparatuses 35 and 36 are dehumidifying apparatuses using a synthetic zeolite catalyst. Two dehumidifying apparatuses 35 and 36 are arranged in parallel in order to assure continuous operation.

After the dew point of gas is lowered by removing oxygen and moisture using the refiner, the gas can be ejected through the outlets 23*a* to 23*e*, via the gas-delivery tubes 19 and 19*a* to 19*e*, into the furnace. Using the valves (not shown) and the flowmeters (not shown) which are respectively disposed midway along each of the gas-delivery tubes 19*a* to 19*e*, the amounts of gas ejected through the respective outlets into the furnace can be individually controlled. Supply of the atmosphere gas through these outlets can also be independently stopped.

In the case where a steel strip is annealed and subsequently subjected to hot-dip galvanizing using the above-described continuous hot-dip galvanizing line, the steel strip 1 is heated to a predetermined temperature (e.g., about 800° C.) and then annealed while being transported through the heating zone 3 and the soaking zone 4. The annealed steel strip is cooled to a predetermined temperature in the cooling zone 5. After being cooled, the resulting steel strip is transported through the snout 6 and then dipped in the plating bath 7 to perform hot-dip galvanizing. After the hot-dip galvanized steel strip is taken up from the plating bath, the amount of plated metal deposited is reduced to a desired amount using the gas-wiping nozzle 8 disposed above the plating bath. After reducing the amount of plated metal deposited as needed, an alloying treatment of the galvanized steel strip is performed using the heating apparatus 9 disposed above the gas-wiping nozzle 8.

At this time, atmosphere gas is supplied into the furnace through the atmosphere gas supply lines 17. The type of atmosphere gas, the composition of the atmosphere gas, and the method for supplying the atmosphere gas are as in the common method. Generally, $H_2$—$N_2$ gas is employed, which is supplied into each zone of the furnace such as the heating zone 3, the soaking zone 4, the cooling zone 5, and the subsequent zones.

The atmosphere gases in the heating zone 3, the soaking zone 4, and the throat section 14 located at the lower part of the joining section 13, through which the soaking zone 4 and the cooling zone 5 are joined, are drawn through the respective gas inlets 22*a* to 22*e* using a blower 33. The drawn atmosphere gas is passed through the heat exchanger 30 and then the cooler 31 and thereby cooled to about 40° C. or less. The cooled atmosphere gas is then cleaned through the filter 32. Subsequently, oxygen contained in the atmosphere gas is removed using the oxygen removing apparatus 34 and dehumidification of the atmosphere gas is performed using the dehumidifying apparatus 35 or 36. Thus, the dew point of the atmosphere gas is lowered to about −60° C. Switching between the dehumidifying apparatuses 35 and 36 is done by operating the switching valves 46 and 51.

The gas having a lowered dew point is passed through the heat exchanger 30 and subsequently returned to the heating zone 3 and the joining section 13, through which the soaking zone 4 and the cooling zone 5 are joined, through the gas outlets 23*a* to 23*e*. By passing the gas having a lowered dew point through the heat exchanger 30, the temperature of gas that is to be ejected into the furnace can be increased.

By disposing the gas inlets and the gas outlets in the above-described manner and by controlling the amount of gas drawn through each inlet and the amount of gas ejected through each outlet to be adequate amounts, retention of atmosphere gas which may occur at the upper parts, the middle parts, and the lower parts of the furnace in the soaking zone and the former part of the cooling zone can be suppressed. Thus, the dew point of the atmosphere gas at the upper part of the furnace can be prevented from becoming high. As a result, prior to starting a normal operation in which steel strips are continuously subjected to a heating treatment or when the moisture concentration and/or the oxygen concentration in the furnace atmosphere is increased during the normal operation, a time required for reducing the moisture concentration and/or the oxygen concentration in the furnace atmosphere and thereby lowering the dew point of the furnace atmosphere to −30° C. or less, at which consistent manufacture of steel strips is realized, can be shortened, which suppresses a reduction in productivity. Furthermore, the dew point of the atmosphere in the soaking zone and the joining section through which the soaking zone and the cooling zone are joined can be lowered to −40° C. or less or may be further lowered to −45° C. or less. Moreover, in the latter part of the heating zone, retention of the atmosphere gas at the upper part, the middle part, and the lower part of the furnace can be suppressed. Consequently, the dew point of the atmosphere in the latter part of the heating zone, the soaking zone, and the joining section through which the soaking zone and the cooling zone are joined can be lowered to −45° C. or less or may be further lowered to −50° C. or less.

In the above-described continuous annealing furnace, the communicating section, through which the heating zone and the soaking zone are communicated, is located above the partition, and the joining section, through which the soaking zone and the cooling zone are joined, is located at the upper part of the furnace. However, the positions of the communicating section and the joining section are not limited to the above-described positions. In the continuous annealing furnace according to the present invention, the communicating section, through which the heating zone and the soaking zone are communicated, may be located below the partition, and the joining section, through which the soaking zone and the cooling zone are joined, may be located at the lower part of the furnace.

In the above-described continuous annealing furnace, the partition 12 is interposed between the heating zone 3 and the soaking zone 4. However, in the continuous annealing furnace according to the present invention, a partition between the heating zone 3 and the soaking zone 4 may be omitted.

In the above-described continuous annealing furnace, a preheating furnace is not disposed upstream of the heating zone. However, a preheating furnace may be disposed in the continuous annealing furnace according to the present invention.

Embodiments of the present invention are described above taking a CGL as an example. However, the present invention may also be applied to a continuous annealing line (CAL) in which steel strips are continuously annealed.

Due to the above-described actions, prior to starting a normal operation in which steel strips are continuously subjected to a heating treatment or when the moisture concentration and/or the oxygen concentration in the furnace atmosphere is increased during the normal operation, a time required for reducing the moisture concentration and/or the oxygen concentration in the furnace atmosphere and thereby lowering the dew point of the furnace atmosphere to −30° C. or less, at which consistent manufacture of steel strips is realized, can be shortened, which suppresses a reduction in productivity. In addition, a furnace atmosphere having a low dew point of −40° C. or less, which is less likely to cause pick-up defects and damages to furnace walls and which suppresses formation of an oxide of an oxidizable element such as Si, Mn, or the like contained in steel which concentrates at the surface of the steel strip during annealing, can be consistently prepared.

Example 1

Dew-point measurement tests were conducted using an ART-type (all-radiant type) CGL (annealing-furnace length (total length of steel-strip passes inside the annealing furnace): 400 m, furnace height in the heating zone and the soaking zone: 20 m) shown in FIG. 1. The furnace width of the heating zone was 12 m. The furnace width of the soaking zone was 4 m. Note that, the term "furnace width" used herein refers to a furnace width measured in the furnace-length direction. The furnace volume of the heating zone was 570 $m^3$ and the furnace volume of the soaking zone was 300 $m^3$.

Atmosphere-gas supply points, at which atmosphere gas was supplied from the outside of the furnace, were disposed as follows. In the soaking zone, three atmosphere-gas supply points were arranged in the furnace-length direction at heights of 1 m and 10 m above the furnace floor on the driving side respectively. That is, in total, six atmosphere-gas supply points were disposed in the soaking zone. In the heating zone, eight atmosphere-gas supply points were arranged in the furnace-length direction at heights of 1 m and 10 m above the furnace floor on the driving side respectively. That is, in total, sixteen atmosphere-gas supply points were disposed in the heating zone. The dew point of the atmosphere gas supplied was −60° C.

FIG. 2 shows the positions of the gas inlets through which gas was drawn into the refiner, gas outlets through which gas was ejected from the refiner, and the dew-point-sensing points. In FIG. 2, the chain double-dashed lines show the vertical positions of the shafts of the upper hearth rolls and the lower hearth rolls disposed in the heating zone and the soaking zone.

The gas inlets and the gas outlets, which were associated with the refiner, were disposed as follows. Specifically, the gas inlets were disposed at the following positions: at the throat section located at the lower part of the joining section through which the soaking zone and the cooling zone were joined (22*e*: "lower part of communicating section"); at a position 1 m below the shafts of the upper hearth rolls disposed in the soaking zone (22*b*: "upper part of soaking zone"); at the center of the soaking zone (center both in the height direction and the furnace-length direction: 22*c*: "middle part of soaking zone"); at a position 1 m above the shafts of the lower hearth rolls disposed in the soaking zone (22*d*: "lower part of soaking zone"); and in the vicinity of the entry side of the furnace, at the lower part of the heating zone (position 1 m above the shafts of the lower hearth rolls and 0.5 m forward and rearward of the pass line in the furnace-length direction: 22*a*: "vicinity of heating-zone-entry side"). The above-described gas inlets were configured so that inlets at which gas was to be drawn can be selected. The gas outlets, through which gas was ejected from the refiner into the furnace, were disposed at the following positions: at a position 1 m from both the exit-side furnace wall and the ceiling of the joining section through which the soaking zone and the cooling zone were joined (23*e*: "upper part of joining section"); and at four positions 1 m below the shafts of the upper hearth rolls disposed in the heating zone, at intervals of 2 m with the starting point located at a position 1 m from the furnace wall on the furnace-entry side (23*a* to 23*d*: "upper part of heating zone: first to fourth outlets from entry side").

The diameter of the inlets was ϕ00 mm. The inlets were disposed in pairs except in the joining section at intervals of 1 m; in the joining section, a single inlet was disposed. The diameter of the outlets was ϕ50 mm. In the joining section, a single outlet was disposed; at the upper part of the heating zone, the outlets were disposed in groups of four at intervals of 2 m.

In the refiner, synthetic zeolite was used in the dehumidifying apparatus, and a palladium catalyst was used in the oxygen removing apparatus.

The tests were conducted using a steel strip having a thickness of 0.8 to 1.2 mm and a width of 950 to 1000 mm at an annealing temperature of 800° C. and at a sheet-passing speed of 100 to 120 mpm. The above-described conditions for the tests were unified as far as possible. Table 1 shows the alloy content of the steel strip used.

The atmosphere gas supplied was $H_2$—$N_2$ gas ($H_2$ concentration: 10 vol %, dew point: −60° C.). The dew point of atmosphere gas measured 1 hr after starting operation of the refiner was examined with reference to the dew point (initial dew point, −34° C. to −36° C.) of the atmosphere measured in the case where the refiner was not used. The flow rate of the gas supplied to the refiner was set to 1500 $Nm^3$/hr.

The dew point of the atmosphere gas was measured at the following points: at the point intermediate between the two gas outlets disposed on the furnace-entry side (24*a*: "vicinity of furnace-entry side"); at the joining section through which the soaking zone and the cooling zone are joined (24*h*: "communicating section"); at the points intermediate between two inlets of each pair disposed in the soaking zone (24*e* to 24*g*: "upper part of soaking zone", "center of soaking zone", and "lower part of soaking zone", respectively); at the point intermediate between the third and fourth outlets from the furnace-entry-side wall in the heating zone (point intermediate between outlets 23*c* and 23*d*: 24*b*: "upper part of heating zone"); at the center of the heating zone (center both in the height direction and in the furnace-length direction: 24*c*: "center of heating zone"); and at the position 1 m above the shafts of the lower hearth rolls disposed in the heating zone and 6 m from the furnace-entry-side wall (24*d*: "lower part of heating zone").

Table 2 shows the distribution of the initial dew points (dew points measured when the refiner was not used) and the dew-point lowering effect determined at the positions at which gas was drawn into the refiner. Note that, the items in Table 2 (descriptions enclosed in " " above) correspond to the above-described positions of the inlets, the outlets, and the dew-point measurement.

Figure 5:
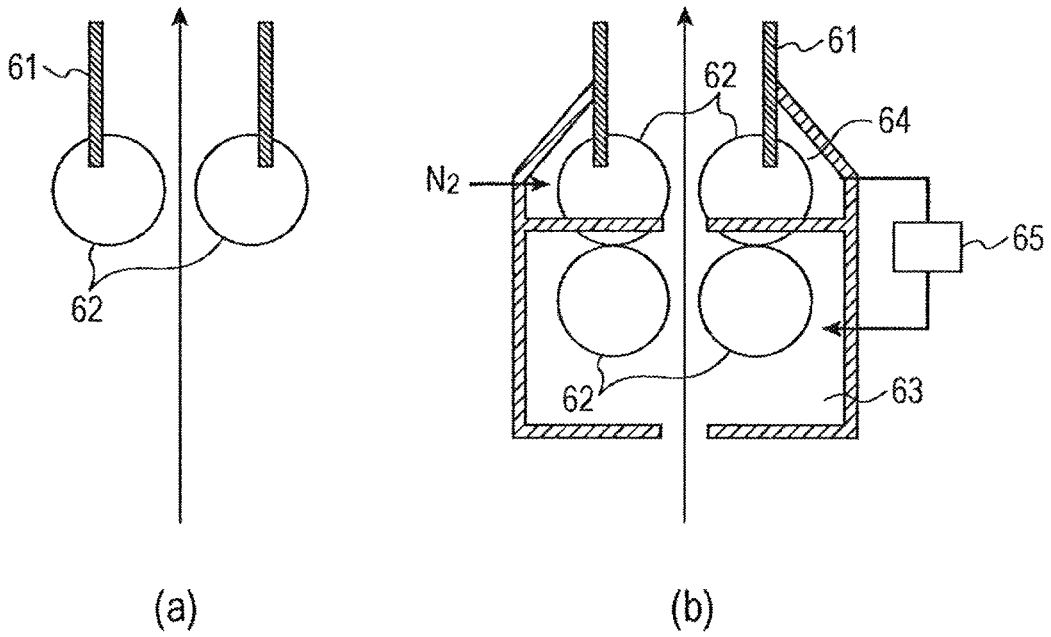
FIG. 5 includes diagrams for explaining a method for sealing the entry side of the furnace.

In Nos. 1 to 8 shown in Table 2, as shown in FIG. 5(*a*), the entry side of the furnace was sealed by the common method in which seal rolls 62 are disposed at the entrance of the annealing furnace 61. In No. 9 shown in Table 2, the seal at the entry side of the furnace was tightened. Specifically, as shown in FIG. 5(*b*), two pairs of seal rolls 62 were arranged in the direction in which steel strips were transported. A first roll chamber 63 that housed the first pair of the seal rolls 62 and a second roll chamber 64 that housed the second pair of the seal rolls 62 were provided. $N_2$ gas was supplied from the outside into the second roll chamber 64 at a flow rate of 25 $Nm^3$/hr. Using a fan 65, atmosphere gas was drawn from the second roll chamber 64 at a flow rate of 25 $Nm^3$/hr, and the drawn gas was then ejected into the first roll chamber 63. Thereby, the seal at the entry side of the furnace was tightened.

TABLE 1

(mass %)

| C | Si | Mn | S | Al |
|---|---|---|---|---|
| 0.12 | 1.3 | 2.0 | 0.003 | 0.03 |

TABLE 2

| | Dew point *1) | | | | | | | | Amount of gas drawn through inlets | | |
|---|---|---|---|---|---|---|---|---|---|---|---|
| No. | Communicating section ° C. | Upper part of soaking zone ° C. | Center of soaking zone ° C. | Lower part of soaking zone ° C. | Upper part of heating zone ° C. | Center of heating zone ° C. | Lower part of heating zone ° C. | Vicinity of furnace-entry side ° C. | Lower part of communicating section $Nm^3$/hr | Upper part of soaking zone $Nm^3$/hr | Middle part of soaking zone $Nm^3$/hr |
| 1 | −34.9 | −33.7 | −33.2 | −35.0 | −38.7 | −38.1 | −37.1 | −34.5 | 0 | 0 | 0 |
| 2 | −51.3 | −51.4 | −52.3 | −52.5 | −51.6 | −51.3 | −51.5 | −47.9 | 300 | 1200 | 0 |
| 3 | −52.5 | −54.5 | −53.8 | −54.5 | −53.9 | −53.8 | −53.3 | −47.2 | 300 | 800 | 0 |
| | −1.2 | −3.1 | −1.5 | −2.0 | −2.3 | −2.5 | −1.8 | 0.7 | | | |
| 4 | −52.5 | −54.6 | −55.1 | −55.2 | −54.4 | −54.0 | −53.7 | −47.6 | 300 | 1000 | 0 |
| | −1.2 | −3.2 | −2.8 | −2.7 | −2.8 | −2.7 | −2.2 | 0.3 | | | |
| 5 | −51.2 | −51.8 | −52.8 | −52.7 | −51.7 | −51.6 | −50.6 | −45.1 | 300 | 600 | 0 |
| | 0.1 | −0.4 | −0.5 | −0.2 | −0.1 | −0.3 | 0.9 | 2.8 | | | |
| 6 | −51.0 | −49.5 | −50.2 | −50.9 | −48.7 | −47.7 | −46.8 | −44.4 | 300 | 500 | 0 |
| | 0.3 | 1.9 | 2.1 | 1.6 | 2.9 | 3.6 | 4.7 | 3.5 | | | |
| 7 | −48.8 | −46.4 | −47.3 | −48.1 | −44.8 | −44.0 | −42.6 | −39.5 | 300 | 200 | 0 |
| | 2.5 | 5.0 | 5.0 | 4.4 | 6.8 | 7.3 | 8.9 | 8.4 | | | |
| 8 | −47.8 | −43.4 | −44.0 | −44.9 | −41.8 | −40.8 | −38.9 | −35.9 | 300 | 0 | 0 |
| | 3.5 | 8.0 | 8.3 | 7.6 | 9.8 | 10.5 | 12.6 | 12.0 | | | |
| 9 | −52.1 | −53.3 | −53.4 | −53.9 | −53.4 | −53.6 | −53.6 | −47.3 | 300 | 500 | 0 |
| | −0.8 | −1.9 | −1.1 | −1.4 | −1.8 | −2.3 | −2.1 | 0.6 | | | |

TABLE 2-continued

| No. | Amount of gas drawn through inlets: Lower part of soaking zone $Nm^3/hr$ | Amount of gas drawn through inlets: Vicinity of heating-zone-entry side $Nm^3/hr$ | Amount of gas ejected through outlets: Upper part of communicating section $Nm^3/hr$ | Amount of gas ejected through outlets: Upper part of heating zone - first outlet from entry side $Nm^3/hr$ | Amount of gas ejected through outlets: Upper part of heating zone - second outlet from entry side $Nm^3/hr$ | Amount of gas ejected through outlets: Upper part of heating zone - third outlet from entry side $Nm^3/hr$ | Amount of gas ejected through outlets: Upper part of heating zone - fourth outlet from entry side $Nm^3/hr$ | Remarks |
|---|---|---|---|---|---|---|---|---|
| 1 | 0 | 0 | 0 | 0 | 0 | 0 | 0 | Comparative Example |
| 2 | 0 | 0 | 300 | 300 | 300 | 300 | 300 | Comparative Example |
| 3 | 0 | 400 | 300 | 300 | 300 | 300 | 300 | Invention Example |
| 4 | 0 | 200 | 300 | 300 | 300 | 300 | 300 | Invention Example |
| 5 | 0 | 600 | 300 | 300 | 300 | 300 | 300 | Invention Example |
| 6 | 0 | 700 | 300 | 300 | 300 | 300 | 300 | Comparative Example |
| 7 | 0 | 1000 | 300 | 300 | 300 | 300 | 300 | Comparative Example |
| 8 | 0 | 1200 | 300 | 300 | 300 | 300 | 300 | Comparative Example |
| 9 | 0 | 700 | 300 | 300 | 300 | 300 | 300 | Invention Example (seal was tightened) |

*1) Dew point: The values in the upper rows are dew points and the values in the lower rows are differences in dew point compared with that of No. 2

In Nos. 3 to 5, in which gas was drawn through the inlet disposed in the vicinity of the entry side of the furnace and supplied into the refiner while the amount of gas drawn was controlled so that the dew point measured at the inlet was increased by less than 3° C. compared with No. 2 in which gas was not drawn into the refiner through the inlets disposed in the vicinity of the entry side of the furnace, a reduction in dew point was achieved except in the vicinity of the entrance of the furnace. Note that, No. 1 is an example where the refiner was not used. On the other hand, in Nos. 6 to 8, where the dew point of gas measured on the furnace-entry side was increased by 3° C. or more, the dew point of gas was higher than in No. 2. In No. 9, where the conditions for drawing gas into the refiner and ejecting gas from the refiner were the same as in No. 6 but the seal at the furnace-entry side was tightened, an increase in dew point measured in the vicinity of the entry side of the furnace was controlled to less than 3° C. and, in addition, the dew point was markedly lowered. This is presumably because, due to the effect of tightening the seal at the entrance of the furnace, the outside air was less likely to be drawn even when a large amount of gas was drawn at the entrance of the furnace, which lowered the dew point.

In the above-described example, a continuous annealing furnace including a partition interposed between the heating zone and the soaking zone was shown as an example. However, the effect of the present invention can be produced even with a continuous annealing furnace without the partition. That is, regardless of the presence or absence of a partition, a reduction in dew point can be achieved by the method according to the present invention.

Example 2

The tendency in which the dew point was lowered was examined using the ART-type (all-radiant-type) CGL shown in FIG. 1, which was used in Example 1.

The conditions of the existing method (a refiner is not used) were as follows. The composition of the atmosphere gas supplied into the furnace included $H_2$: 8 vol % and the balance being $N_2$ and inevitable impurities (dew point: −60° C.) The flow rate of the atmosphere gas supplied into the furnace was set as in Example 1. A steel strip (alloy content in steel was as in Table 1) having a thickness of 0.8 to 1.2 mm and a width of 950 to 1000 mm was used. The annealing temperature was set to 800° C. The sheet-passing speed was set to 100 to 120 mpm. The conditions for operating a refiner in the method according to the present invention were the same as in No. 3 of Example 1 shown in Table 2.

FIG. 3 shows the examination results. The term "dew point" used in FIG. 3 refers to a dew point measured at the upper part of the soaking zone.

In the existing method, about 40 hours was required to lower the dew point to −30° C. or less. Even after 70 hours, the dew point could not be lowered to −35° C. In contrast, in the method according to the present invention, the dew point was able to be lowered to −30° C. or less in 4 hours, to −40° C. or less in 7 hours, and to −50° C. or less in 12 hours.

The present invention is applicable to a method for annealing steel strips in which, prior to starting a normal operation in which steel strips are continuously subjected to a heating treatment or when the moisture concentration and/or the oxygen concentration in the furnace atmosphere is increased during the normal operation, the moisture concentration and/or the oxygen concentration in the furnace atmosphere is reduced and thereby the dew point of the furnace atmosphere is lowered to −30° C. or less, at which consistent manufacture of steel strips is realized, in a short time.

The present invention is applicable to a method for annealing high-strength steel strips containing oxidizable elements such as Si and Mn. This method may be effectively applied to an annealing furnace including a partition interposed between the soaking zone and the heating zone and which is less likely to cause pick-up defects and damages to furnace walls.

REFERENCE SIGNS LIST

1 steel strip
2 annealing furnace

3 heating zone
4 soaking zone
5 cooling zone
5*a* first cooling zone
5*b* second cooling zone
6 snout
7 plating bath
8 gas-wiping nozzle
9 heating apparatus
10 refiner
11*a* upper hearth rolls
11*b* lower hearth rolls
12 partition
13 joining section
14 throat section
15 roll
16 seal roll
17 atmosphere gas supply lines
18 gas-introduction tubes
19 gas-delivery tubes
22*a* to 22*e* gas inlets
23*a* to 23*e* gas outlets
24*a* to 24*h* dew-point-sensing points
30 heat exchanger
31 cooler
32 filter
33 blower
34 oxygen removing apparatus
35 and 36 dehumidifying apparatus
46 and 51 switching valves
40 to 45, 47 to 50, 52, and 53 valves
61 annealing furnace entrance
62 seal roll
63 first roll chamber
64 second roll chamber
65 fan

The invention claimed is:

1. A continuous annealing furnace for annealing steel strips that is a vertical-type annealing furnace comprising a heating zone, a soaking zone, and a cooling zone which are disposed in the annealing furnace in this order and in which the steel strips are transported vertically, the vertical-type annealing furnace being configured so that, while atmosphere gas is supplied from the outside of the furnace into the furnace and gas inside the furnace is exhausted from a steel-strip-introduction section located at the lower part of the heating zone, part of the gas inside the furnace is drawn and introduced to a refiner disposed outside the furnace, the refiner including an oxygen removing apparatus and a dehumidifying apparatus, oxygen and moisture contained in the gas are removed to lower the dew point of the gas, and gas having a lowered dew point is put back into the furnace, wherein at least one gas inlet through which gas is drawn from the furnace into the refiner is disposed in the vicinity of the entry side of the furnace at a distance of 6 m or less in the vertical direction and 3 m or less in the furnace-length direction from the steel-strip-introduction section located at the lower part of the heating zone.

2. A continuous hot-dip galvanizing facility comprising a hot-dip galvanizing facility downstream of the continuous annealing furnace according to claim 1.

* * * * *